US009880575B2

(12) United States Patent
Tai

(10) Patent No.: US 9,880,575 B2
(45) Date of Patent: Jan. 30, 2018

(54) POWER CONVERTER AND METHOD OF USE

(71) Applicant: TAIWAN SEMICONDUCTOR MANUFACTURING COMPANY, LTD., Hsinchu (TW)

(72) Inventor: Chia Liang Tai, Taichung (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 246 days.

(21) Appl. No.: 14/097,487

(22) Filed: Dec. 5, 2013

(65) Prior Publication Data

US 2015/0160667 A1 Jun. 11, 2015

(51) Int. Cl.
*G05F 1/575* (2006.01)
*G05F 1/59* (2006.01)

(52) U.S. Cl.
CPC ..... *G05F 1/575* (2013.01); *G05F 1/59* (2013.01)

(58) Field of Classification Search
CPC ..... G05F 1/59; G05F 1/575
USPC ..... 323/273
See application file for complete search history.

(56) References Cited

U.S. PATENT DOCUMENTS 6,801,026 B2 10/2004 Schrom et al.
8,207,719 B2 * 6/2012 Shiota ..... 323/266
8,259,476 B2 9/2012 Ben-Yaakov et al.
2006/0164888 A1 * 7/2006 Pisasale ..... G11O 5/147 365/185.18
2008/0278125 A1 * 11/2008 Pigott ..... H02M 1/38 323/271
2009/0224734 A1 * 9/2009 Tang ..... H03K 17/164 323/272
2012/0062201 A1 * 3/2012 Hachiya ..... H02M 3/1588 323/283
2012/0105032 A1 * 5/2012 Huard ..... H02M 3/158 323/271
2013/0176015 A1 * 7/2013 Sato ..... H02M 1/088 323/317

(Continued)

OTHER PUBLICATIONS

SN54AS867, SN54AS869 SN74ALS867A, SN74ALS869, SN74AS867, SN74AS869 Synchronous 8-Bit Up/Down Counters SDAS115C—Dec. 1982—Revised Jan. 1995 http://www.ti.com/lit/ds/symlink/sn54as867.pdf.*

(Continued)

*Primary Examiner* — Fred E Finch, III
*Assistant Examiner* — Rafael O. De Leon Domenech
(74) *Attorney, Agent, or Firm* — Hauptman Ham, LLP

(57) ABSTRACT

A power converter includes a power supply node, an output node, a plurality of driving units, a feedback unit, a comparator, and a control unit. Two or more of the plurality of driving units are configured to be activated or to be deactivated responsive to a plurality of control signals. The feedback unit is configured to provide a feedback voltage based on an output voltage at the output node. The comparator is configured to provide an indication signal. The control unit is configured to generate the plurality of control signals based on the indication signal. The control unit is configured to, through the plurality of control signals, increase or decrease a number of activated driving units of the plurality of driving units by one or more predetermined increments at a time.

21 Claims, 9 Drawing Sheets

(56) References Cited

U.S. PATENT DOCUMENTS

2015/0042301 A1* 2/2015 Narwal ..... 323/281

OTHER PUBLICATIONS

Vincent Ng, Seth Sanders, "A 92%-Efficiency Wide-Input-Voltage-Range Switched-Capacitor DC-DC Converter", ISSCC 2012 / Session 16 / Switching Power Control Techniques / 16.5, 2012 IEEE International Solid-State Circuits Conference.

* cited by examiner

POWER CONVERTER AND METHOD OF USE

BACKGROUND

Power converters are utilized in many electrical circuit applications. For example, a digital low drop out (LDO) power converter converts a supply voltage at a power supply node to an output voltage at an output node by turning on or off a transistor between the power supply node and the output node. In some applications, a capacitor is connected between the output node and a ground reference node and functions as a low-pass filter to reduce ripples of the output voltage. However, when the transistor of the LDO power converter is turned on or off, a transient current is caused to be injected into or withdrawn from the capacitor, which in turn increases ripples of the output voltage attributable to the transient current and the equivalent series resistance (ESR) of the capacitor.

DESCRIPTION OF THE DRAWINGS

One or more embodiments are illustrated by way of example, and not by limitation, in the figures of the accompanying drawings, wherein elements having the same reference numeral designations represent like elements throughout.

DETAILED DESCRIPTION

Figure 1:
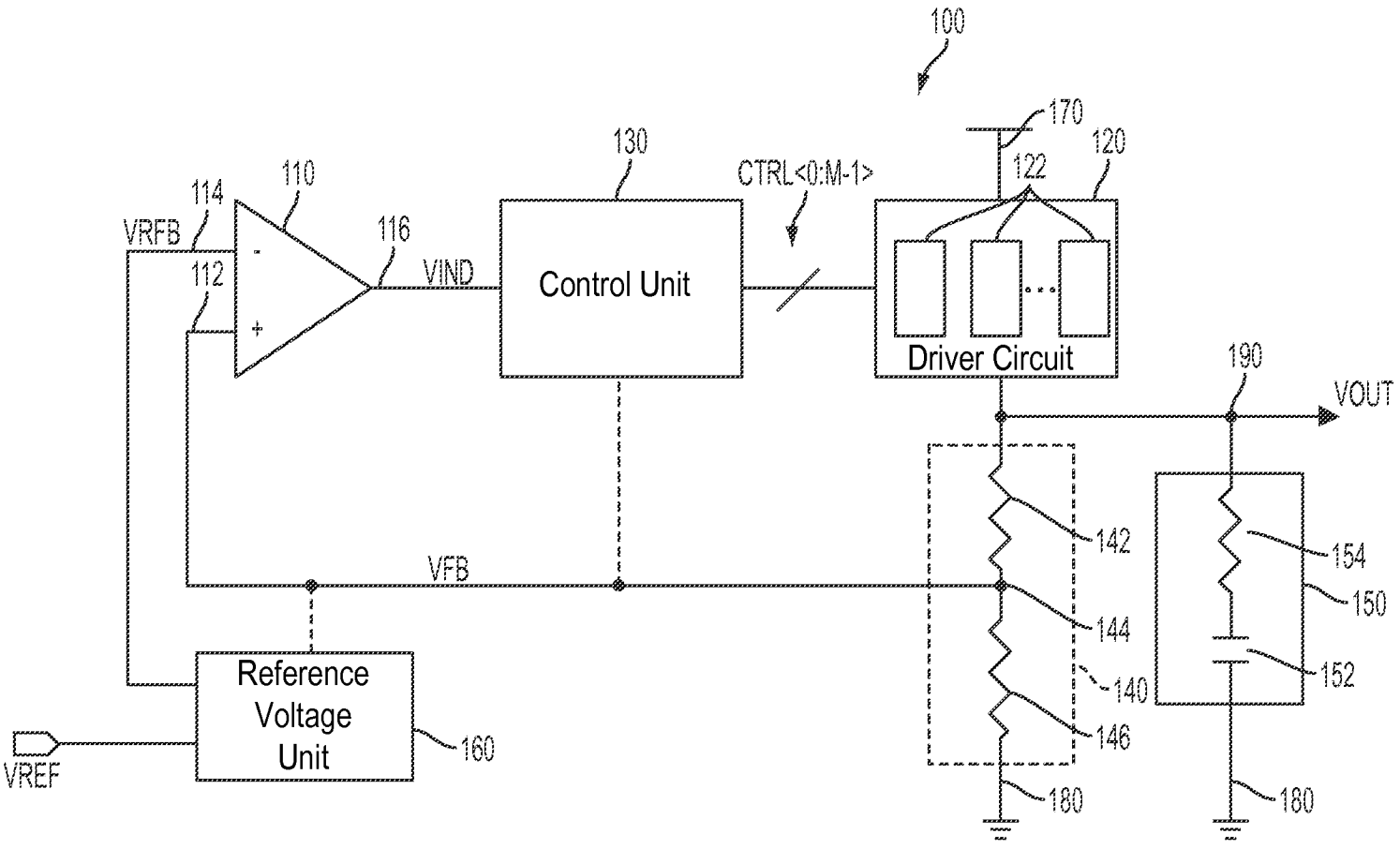
FIG. 1 is a diagram of a power converter in accordance with one or more embodiments.

It is understood that the following disclosure provides one or more different embodiments, or examples, for implementing different features of the disclosure. Specific examples of components and arrangements are described below to simplify the present disclosure. These are, of course, examples and are not intended to be limiting. In accordance with the standard practice in the industry, various features in the drawings are not drawn to scale and are used for illustration purposes only.

FIG. 1 is a diagram of a power converter 100 in accordance with one or more embodiments. Power converter 100 includes a comparator 110, a driver circuit 120, a control unit 130, a feedback unit 140, a capacitive device 150, a reference voltage unit 160, a power supply node 170, a ground reference node 180, and an output node 190. Driver circuit 120 is coupled between power supply node 170 and output node 190. Feedback unit 140 is coupled between the output node 190 and a first input terminal 112 of comparator 110, and capacitive device 150 is coupled between output node 190 and ground reference node 180.

Comparator 110 includes a first input terminal 112 configured to receive a feedback voltage VFB, a second input terminal 114 configured to receive a reference voltage VRFB, and an output terminal 116 configured to provide an indication signal VIND generated based on the signals at first input terminal 112 and second input terminal 114. In some embodiments, comparator 110 sets indication signal VIND at a first logic state, e.g., a logic high level, when feedback voltage VFB is greater than reference voltage VRFB by a first hysteresis voltage difference. In some embodiments, comparator 110 sets indication signal VIND at a second logic state, e.g., a logic low level, when feedback voltage VFB is less than reference voltage VRFB by a second hysteresis voltage difference. In some embodiments, first and second hysteresis voltage differences range from 0 millivolts (mV) to 15 mV.

Driver circuit 120 includes a plurality of driving units 122, e.g., M driving units, where M is a positive integer equal to or greater than 2. Two or more of the plurality of driving units 122 are configured to be activated to turn on corresponding current paths between the power supply node 170 and the output node 190 or to be deactivated to turn off the corresponding current paths between the power supply node 170 and the output node 190 responsive to a plurality of control signals CTRL<0:M−1>. In some embodiments, all driving units of the plurality of driving units 122 are configured to be activated or deactivated responsive to control signals CTRL<0:M−1>. Details of driver circuit 120 are further illustrated in conjunction with FIGS. 2A and 2B.

Control unit 130 is configured to generate the plurality of driving signals CTRL<0:M−1> based on the indication signal VIND. In some embodiments, control unit 130 is configured to, through the plurality of driving signals CTRL<0:M−1>, increase or decrease a number of activated driving units of the plurality of driving units 122 by one or more predetermined increments at a time. In some embodiments, control unit 130 is configured to increase or decrease the number of activated driving units of the plurality of driving units 122 by one at a time. Details of control unit 130 are further illustrated in conjunction with FIGS. 3 and 7. In some embodiments, the one or more predetermined increments are less than a total number of the plurality of driving units 122.

Feedback unit 140 is configured to generate feedback voltage VFB based on an output voltage VOUT at output node 190. In the embodiment depicted in FIG. 1, feedback unit 140 is a voltage divider including a first resistive device 142 between output node 190 and a feedback node 144 and a second resistive device 146 between feedback node 144 and ground reference node 180. As such, output voltage VOUT is scaled to become voltage VFB according to resistance values of resistive devices 142 and 146. In some embodiments, output node 190 and feedback node 144 are electrically connected together, and resistive devices 142 and 146 are omitted. As such, output voltage VOUT is used as feedback voltage VFB.

Capacitive device 150 is a physical component that functions as a low-pass filter to stabilize voltage VOUT. Electrical characteristics of capacitive device 150 are capable of being represented by an equivalent series capacitance (depicted as a capacitor 152) and an equivalent series resistance (ESR, depicted as a resistor 154). In some embodiments, capacitive device 150 and the other components of power converter 100 depicted in FIG. 1 are not in the same chip. In some embodiments, one or more other electrical components are connected between capacitive device 150 and output node 190 or between capacitive device 150 and ground reference node 180.

Reference voltage unit 160 is configured to provide reference voltage VRFB based on an external reference voltage VREF. In some embodiments, reference voltage unit 160 uses external reference voltage VREF as reference voltage VRFB. In some embodiments, reference voltage unit 160 includes a calibration circuit capable of providing reference voltage VRFB based on feedback voltage VFB and external reference voltage VREF in order to compensate an offset voltage between input terminals 112 and 114 of comparator 110.

Figure 2A:
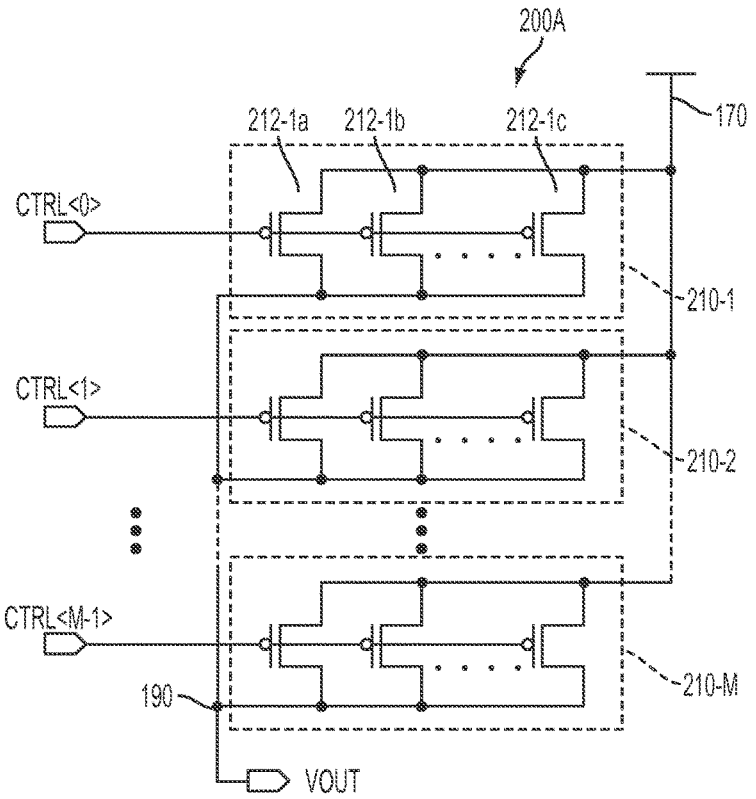
FIG. 2A is a diagram of a driver circuit in accordance with one or more embodiments.

FIG. 2A is a diagram of a driver circuit 200A in accordance with one or more embodiments. Driver circuit 200A is usable as driver circuit 120 in FIG. 1.

Driver circuit 200A includes a plurality of driving units, such as M driving units 210-1, 210-2, and 210-M corresponding to driving units 122 in FIG. 1. Each of the plurality of driving units 210-1, 210-2, and 210-M are configured to be activated to electrically couple the power supply node 170 to the output node 190 or to be deactivated to electrically decouple the power supply node 170 from the output node 190 responsive to a corresponding one of the plurality of control signals CTRL<0>, CTRL<1>, and CTRL<M−1>. In some embodiments, driver circuit 200A includes one or more other driving units that are not controlled by control signals CTRL<0:M−1>.

Each of the plurality of driving units 210-1, 210-2, and 210-M has a plurality of transistors between power supply node 170 and output node 190. For example, driving unit 210-1 has transistors 212-1*a*, 212-1*b*, and 212-1*c*. Although driving unit 210-1 in FIG. 2A has three transistors, in some embodiments, driving unit 210-1 has one, two, or more than three transistors. Transistors 212-1*a*, 212-1*b*, and 212-1*c* are P-type metal-oxide semiconductor (MOS) transistors. Each of transistors 212-1*a*, 212-1*b*, and 212-1*c* has a source terminal coupled to power supply node 170, a drain terminal coupled to output node 190, and a gate terminal coupled to a corresponding one of the plurality of control signals CTRL<0>, CTRL<1>, or CTRL<M−1>. In some embodiments, transistors 212-1*a*, 212-1*b*, and 212-1*c* are P-type transistors other than MOS transistors, such as bipolar transistors or junction field effect transistors. In some embodiments, transistors 212-1*a*, 212-1*b*, and 212-1*c* are N-type transistors.

When control signal CTRL<0> is set to logic high level, transistors 212-1*a*, 212-1*b*, and 212-1*c* are turned off. Thus, driving unit 210-1 is deactivated to electrically decouple power supply node 170 from output node 190. When control signal CTRL<0> is set to logic low level, transistors 212-1*a*, 212-1*b*, and 212-1*c* are turned on. Thus, driving unit 210-1 is activated to electrically couple power supply node 170 to output node 190 in order to turn on a current path between power supply node 170 and output node 190. In some embodiments, driving units 210-2 and 210-M and corresponding control signals CTRL<1> and CTRL<M−1> operate in a manner similar to driving unit 210-1 and control signal CTRL<0>.

Driving units 210-1, 210-2, and 210-M have corresponding current capacities limited by the characteristics of transistors thereof. The more driving units being activated, the greater overall current capacity the driver 120 is capable to provide to a load connected to output node 190.

Figure 2B:
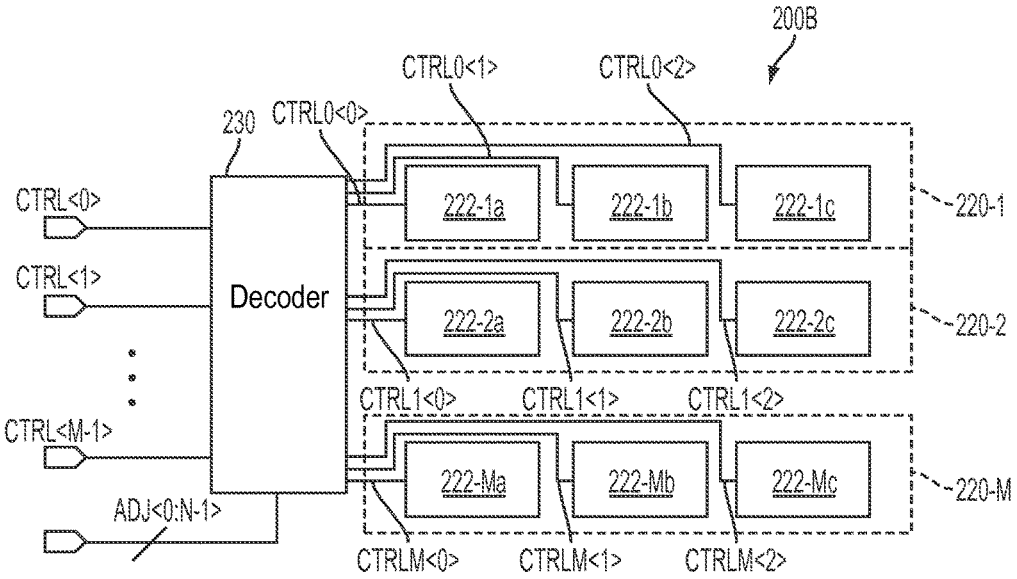
FIG. 2B is a diagram of another driver circuit in accordance with one or more embodiments.

FIG. 2B is a diagram of another driver circuit 200B in accordance with one or more embodiments. Driver circuit 200B is also usable as driver circuit 120 in FIG. 1.

Driver circuit 200B includes a plurality of driving units, such as M driving units 220-1, 220-2, and 220-M. Each of the plurality of driving units 210-1, 210-2, and 210-M further includes a plurality of sub units. For example, driving unit 220-1 includes sub units 222-1*a*, 222-1*b*, and 222-1*c*; driving unit 220-2 includes sub units 222-2*a*, 222-2*b*, and 222-2*c*; and driving unit 220-M includes sub units 222-Ma, 222-Mb, and 222-Mc. Sub units 222-1*a*, 222-1*b*, 222-1*c*, 222-2*a*, 222-2*b*, 222-2*c*, 222-Ma, 222-Mb, and 222-Mc are configured to be activated to electrically couple the power supply node 170 (FIG. 1) to the output node 190 (FIG. 1) or to be deactivated to electrically decouple the power supply node 170 from the output node 190 responsive to a corresponding one of decoded control signals CTRL0<0>, CTRL0<1>, CTRL0<2>, CTRL1<0>, CTRL1<1>, CTRL1<2>, CTRLM<0>, CTRLM<1>, and CTRLM<2>. Although only three columns of sub units are depicted and illustrated in conjunction with FIG. 2B, in some embodiments, there are more or less than three columns of sub units and corresponding decoded sub units. In some embodiments, driver circuit 200B includes one or more other driving units and/or sub units that are not controlled by decoded control signals CTRL0<0:2>, CTRL1<0:2>, and CTRLM<0:2>.

In some embodiments, the sub units of the plurality of driving units are arranged in columns and rows, and each row of sub units corresponds to one of the plurality of driving units. For example, sub units 222-1*a*, 222-1*b*, and 222-1*c* are arranged in a row and correspond to driving unit 220-1; sub units 222-2*a*, 222-2*b*, and 222-2*c* are arranged in a row and correspond to driving unit 220-2; and sub units 222-Ma, 222-Mb, and 222-Mc are arranged in a row and correspond to driving unit 220-M.

Driver circuit 200B further includes a decoder 230. Decoder 230 receives one or more adjustment signals ADJ<0:N−1>, N is zero or a positive integer. In some embodiments, each one of the one or more adjustment signals ADJ<0:N−1> corresponds to enabling or disabling a column of sub units. For example, when ADJ<0> is set to logic high level, sub units 222-1*a*, 222-2*a*, and 222-Ma are enabled and subjected to the control of the plurality of control signals CTRL<0:M−1>; when ADJ<1> is set to logic high level, sub units 222-1*b*, 222-2*b*, and 222-Mb are enabled and subjected to the control of the plurality of control signals CTRL<0:M−1>; and when ADJ<2> is set to logic high level, sub units 222-1*c*, 222-2*c*, and 222-Mc are enabled and subjected to the control of the plurality of control signals CTRL<0:M−1>.

In some embodiments, adjustment signals ADJ<0:N−1> represents a value indicating a number of columns of sub units that would be controllable by control signals CTRL<0:M−1> while the other columns of sub units are deactivated. The actual columns of sub units that are to be enabled or disabled are determined by decoder 230.

In the embodiment depicted in FIG. 2B, decoder 230 is capable of generating decoded control signals CTRL0<0:2>, CTRL1<0:2>, and CTRLM<0:2> based on adjustment signals ADJ<0:N−1> and control signals CTRL<0:M−1>. As a result, decoder 230, through decoded control signals CTRL0<0:2>, CTRL1<0:2>, and CTRLM<0:2>, enables a subset of the plurality of sub units of a corresponding one of the plurality of driving units 220-1, 220-2, and 220-M. The number of sub units capable of being activated in response to control signals CTRL<0:M−1> corresponds to the overall driving capability of driver circuit 200B. As such, the overall driving capability of driver circuit 200B is also adjustable according to adjustment signals ADJ<0:N−1>.

Figure 3:
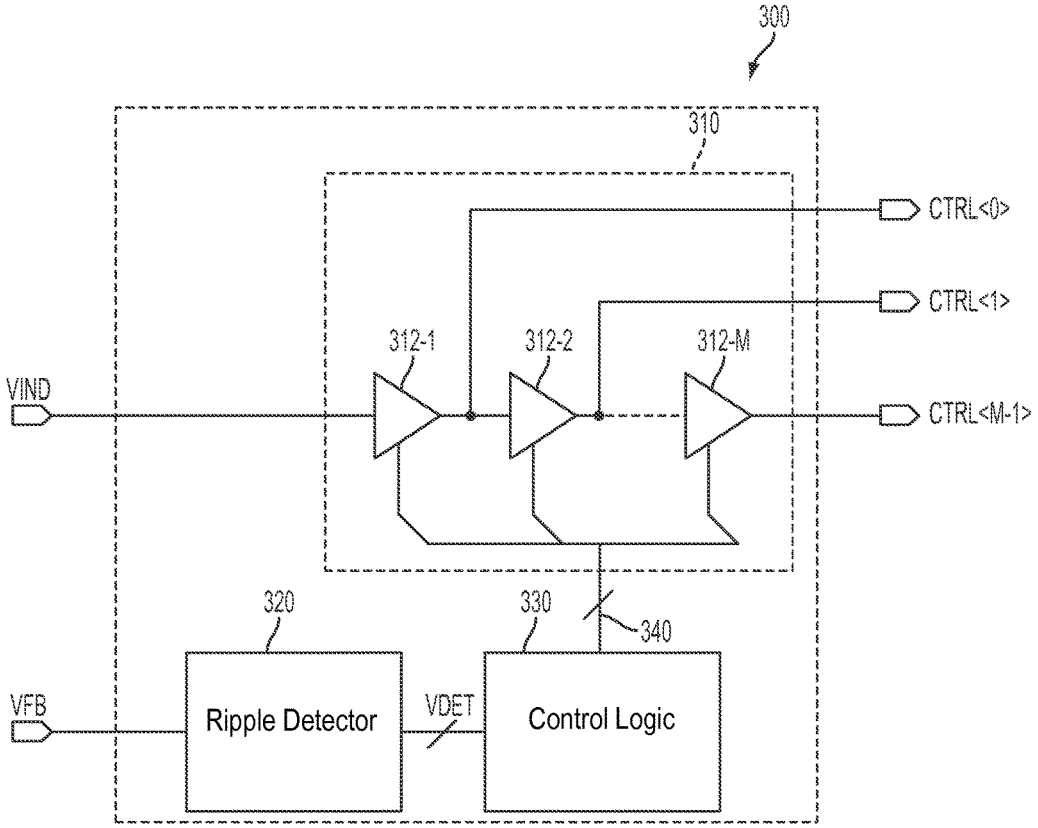
FIG. 3 is a diagram of a control unit in accordance with one or more embodiments.

FIG. 3 is a diagram of a control unit 300 in accordance with one or more embodiments. Control unit 300 is usable as control unit 130 in FIG. 1. Control unit 300 includes a delay control unit 310, a ripple detector 320, and a control logic 330.

Delay control unit 310 includes a plurality of delay units 312-1, 312-2, and 312-M. In some embodiments, delay units 312-1, 312-2, and 312-M are buffers. Delay units 312-1, 312-2, and 312-M are configured to receive indication signal VIND and to generate the plurality of control signals CTRL<0:M−1> by imposing corresponding delays to indication signal VIND. For example, delay unit 312-1 receives indication signal VIND and generates control signal CTRL<0> by imposing a predetermined unit delay to indication signal VIND. Delay unit 312-2 receives control signal CTRL<0> from delay unit 312-1 and generated control signal CTRL<1> by imposing the predetermined unit delay to CTRL<0>, and thus control signal CTRL<1> is effectively generated by imposing twice the predetermined unit delay to indication signal VIND. Delay unit 312-M receives control signal CTRL<M−2> (not shown) from the previous delay unit and generated control signal CTRL<M−1> by imposing the predetermined unit delay to CTRL<M−2>, and thus control signal CTRL<M−1> is effectively generated by imposing M times the predetermined unit delay to indication signal VIND.

Therefore, when indication signal VIND indicates that driver 120 is to be activated, control unit 300 activates, through control signals CTRL<0:M−1>, the plurality of driving units, such as driving unit 122 (FIG. 1) or 210-1, 210-2, or 210-M (FIG. 2A), or 220-1, 220-2, or 220-M (FIG. 2B), one after another separated by the predetermined unit delay.

Ripple detector 320 detects ripple level of output voltage VOUT by measuring feedback voltage VFB. Control logic 330 is capable of adjusting the corresponding delays of driving units 312-1, 312-2, and 312-M according to the detected ripple level. In some embodiments, ripple detector 320 is configured to generate a digital value carried by one or more signals VDET based on the feedback voltage VFB, and control logic 330 is configured to adjust the corresponding delays of delay units 312-1, 312-2, and 312-M through bus 340 according to the digital value from the ripple detector 320.

Figure 4:
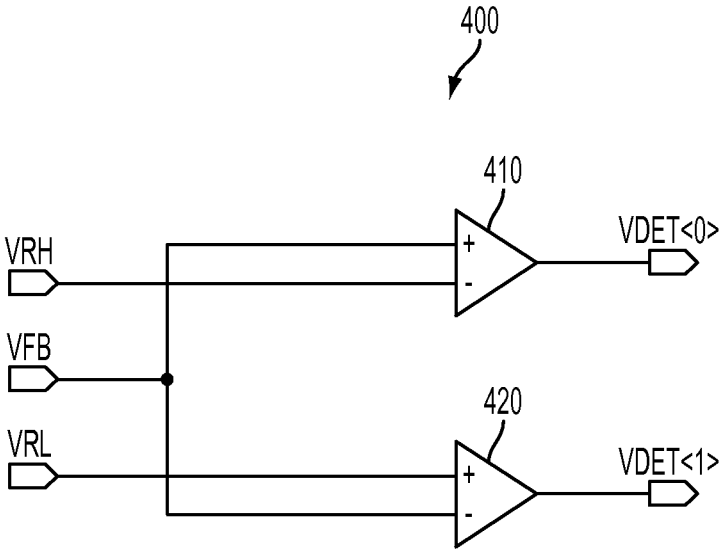
FIG. 4 is a diagram of a ripple detector in accordance with one or more embodiments.

FIG. 4 is a diagram of a ripple detector 400 in accordance with one or more embodiments. Ripple detector 400 is usable as ripple detector 320 in FIG. 3.

Ripple detector 400 includes a first comparator 410 and a second comparator 420. First comparator 410 is configured to compare the feedback voltage VFB with a first detection reference voltage VRH and generate an output VDET<0> accordingly. In some embodiments, when voltage level of feedback voltage VFB is greater than that of the first detection reference voltage VRH, first comparator 410 sets output VDET<0> at logic high level. When voltage level of feedback voltage VFB is equal to or less than that of the first detection reference voltage VRH, first comparator 410 sets output VDET<0> at logic low level. Second comparator 420 is configured to compare the feedback voltage VFB with a second detection reference voltage VRL and generate an output VDET<1> accordingly. In some embodiments, when voltage level of feedback voltage VFB is less than that of the second detection reference voltage VRL, second comparator 420 sets output VDET<1> at logic high level. When voltage level of feedback voltage VFB is equal to or greater than that of the second detection reference voltage VRL, second comparator 420 sets output VDET<1> at logic low level.

In some embodiments, ripple detector 400 is configured to compare more than two detection reference voltages VRH and VRL. In some embodiments, ripple detector 400 is capable of generating signals VDET having a value that indicates the voltage level of VFB with a quantization resolution higher than the example depicted in FIG. 4.

In some embodiments, ripple detector 400 is used as ripple detector 320 in FIG. 3, and control logic 330 in FIG. 3 is configured to increase the corresponding delays of delay units 312-1, 312-2, and 312-3 when the signals VDET from ripple detector 320 indicates that the voltage level of feedback voltage VFB is greater than that of the first detection reference voltage VRH. In some embodiments, logic 330 is further configured to increase the corresponding delays of delay units 312-1, 312-2, and 312-3 when the signals VDET from ripple detector 320 indicates that the voltage level of feedback voltage VFB is less than that of the second detection reference voltage VRL. In some embodiments, logic 330 is further configured to decrease the corresponding delays of delay units 312-1, 312-2, and 312-3 when the signals VDET from ripple detector 320 indicates that the voltage level of feedback voltage VFB is less than that of the first detection reference voltage VRH and greater than that of the second detection reference voltage VRL.

Figure 5A:
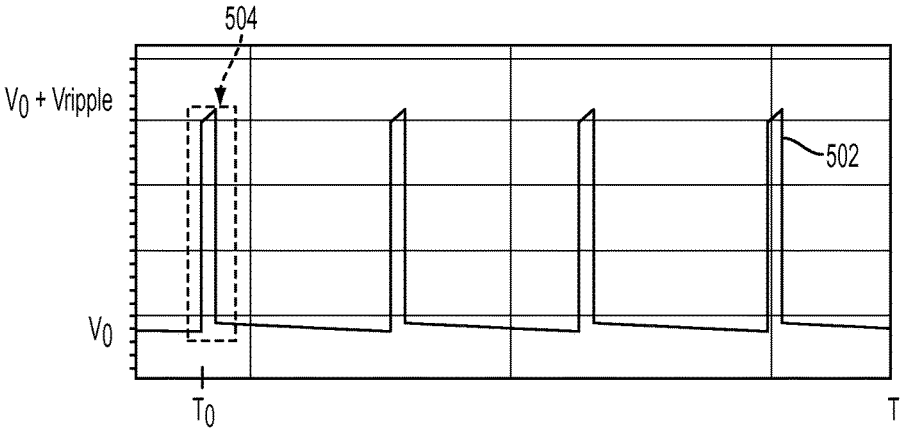
FIG. 5A is a chart of output voltage of a power converter in accordance with one or more embodiments.

FIG. 5A is a chart of output voltage VOUT of a power converter, such as power converter 100, in accordance with one or more embodiments. Curve 502 depicts voltage level of output voltage VOUT in an example power converter as depicted in FIG. 1. For example, power converter 100 is designed to provide a regulated direct current (DC) voltage having voltage level Vo as output voltage VOUT. When all the driving units 122 are turned on at time T0 to provide a predetermined amount of current to a load connected to output node 190, a transient current is also injected into capacitive device 150. The transient current and the ESR (as represented by resistor 154) of capacitive device 150 causes the output voltage VOUT to have a ripple 504 having a voltage level of (V0+Vripple).

Figure 5B:
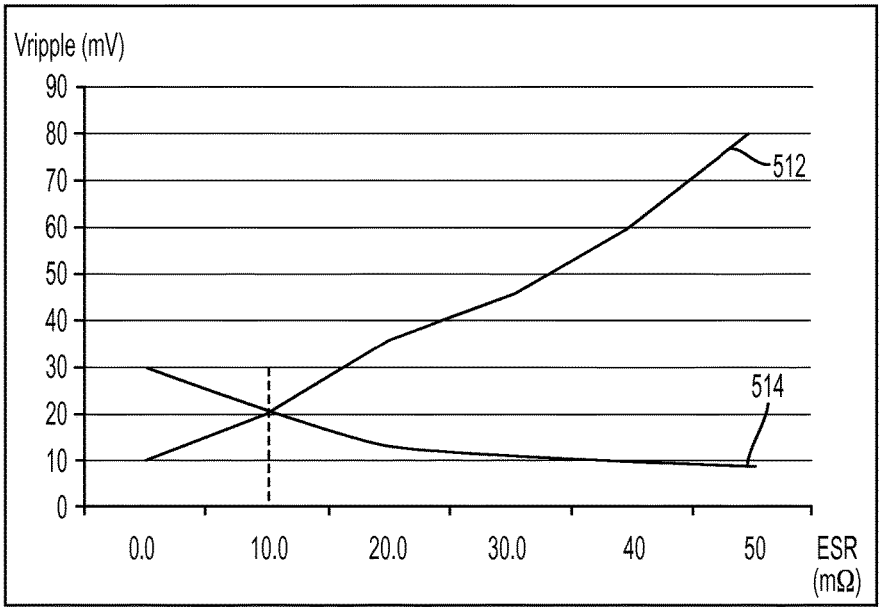
FIG. 5B is a chart of ripples versus ESR under different settings in accordance with one or more embodiments.

FIG. 5B is a chart of ripples versus ESR under different settings in accordance with one or more embodiments. Curve 512 depicts the ripple voltage level Vripple (in mV) versus various ESR value (in milliohms, mΩ) when the corresponding delays are set to 0 nanoseconds (ns) in an example power converter as illustrated in conjunction with FIG. 1, FIG. 2, and FIG. 3. Curve 514 depicts the ripple voltage level Vripple (in mV) versus various ESR value (in mΩ) when the corresponding delays are set to 40 ns. In this example, ripple detector 320 and control logic 330 in FIG. 3 are disabled and thus the delays of the delay units 312-1, 312-2, and 312-M are fixed.

As depicted in FIG. 5B, curve 512 shows that ripple voltage level increases with the ESR value when the corresponding delays of the delay units 312-1, 312-2, and 312-M are set to 0 ns. In other words, ripple voltage level increases with the ESR value when all the driving units 122 of driver 120 are turned on simultaneously. Curve 514 shows that ripple voltage level decreases with the ESR value when the corresponding delays of the delay units 312-1, 312-2, and 312-M are set to 40 ns. However, when ESR is lower than 10 mΩ in this example, small or no delay between activations of different driving units 122 (as represented by curve 512) have lower ripple voltage levels than having a greater delay (as represented by curve 514). In some embodiments, capacitive device 150 and the rest of the power converter 100 are not on the same chip or the ESR value of capacitive device 150 various with different power, temperature, and voltage settings. In this regard, ripple detector 320 and control logic 330 in FIG. 3 are helpful to accommodate various ESR values by dynamically adjusting the delays of the delay units 312-1, 312-2, and 312-M.

Figure 5C:
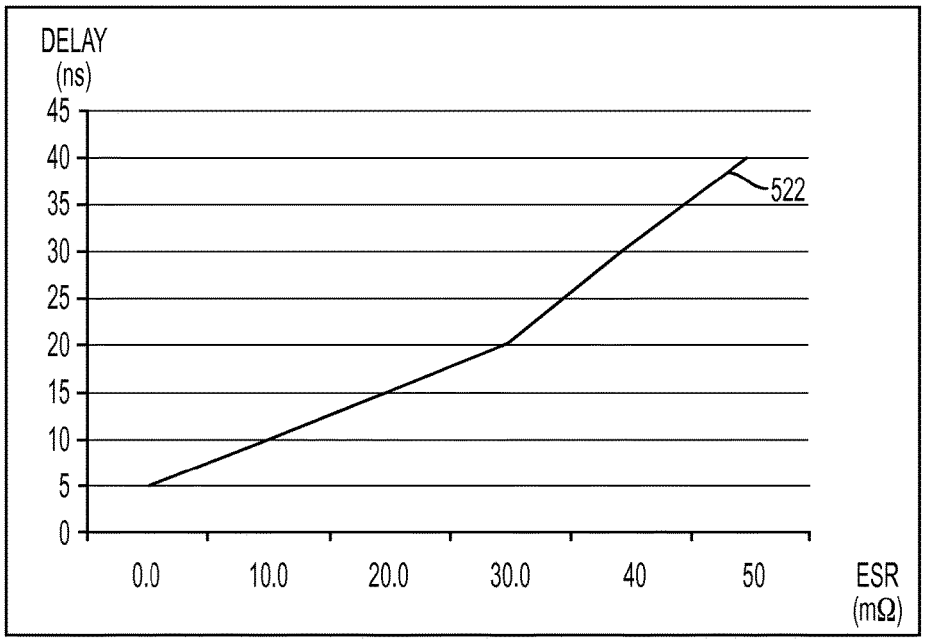
FIG. 5C is a chart of delays versus ESR in accordance with one or more embodiments.
Figure 5D:
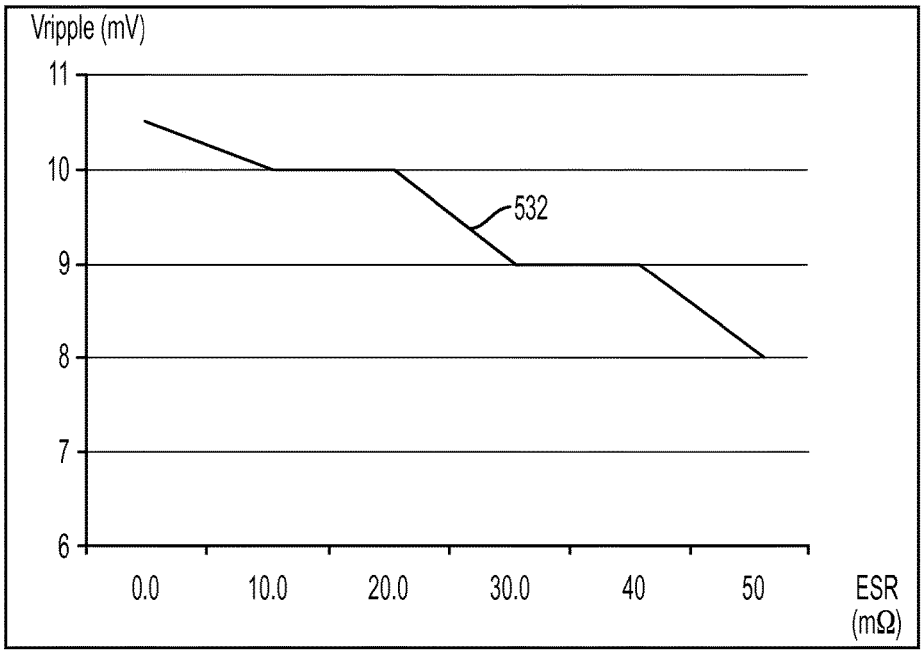
FIG. 5D is a chart of ripples versus ESR using the settings depicted in FIG. 5C in accordance with one or more embodiments.

FIG. 5C is a chart of delays versus ESR in accordance with one or more embodiments. Curve 522 depicts the delay of each delay units 312-1, 312-2, and 312-M versus various ESR value (in mΩ) when ripple detector 320 and control logic 330 in FIG. 3 are enabled to adjust the delays of the delay units 312-1, 312-2, and 312-M. FIG. 5D is a chart of ripples versus ESR using the settings depicted in FIG. 5C in accordance with one or more embodiments. Curve 532 depicts the ripple voltage level Vripple (in mV) versus various ESR value (in mΩ) when the corresponding delays are set according to curve 522 of FIG. 5C. Comparing curve 532 in FIG. 5D and curves 512 and 514 in FIG. 5B, the incorporation and operation of ripple detector 320 and control logic 330 in FIG. 3 allows dynamically adjustment of the delays of delay units 312-1, 312-2, and 312-M responsive to various ESR values. As a result, curve 532 has lower ripple voltage levels than curve 514 even when the ESR is less than 10 mΩ.

Figure 6:
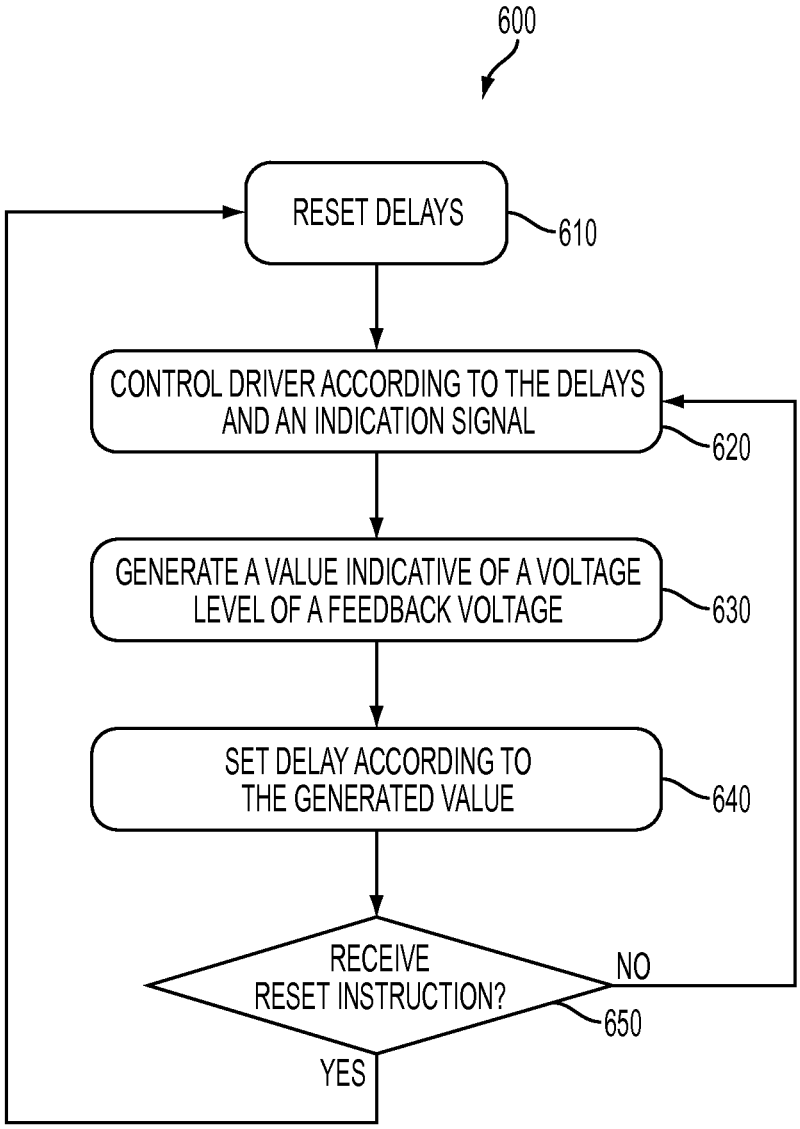
FIG. 6 is a flowchart of a method of operating a power converter including the control unit depicted in FIG. 3 in accordance with one or more embodiments.

FIG. 6 is a flowchart of a method 600 of operating a power converter 100 including the control unit 300 depicted in FIG. 3 in accordance with one or more embodiments. It is understood that additional operations may be performed before, during, and/or after the method 600 depicted in FIG. 6, and that some other processes may only be briefly described herein.

In operation 610, when power converter 100 is powered up, circuit settings stored in or accessible to control logic 330 regarding delays of the delay units 312-1, 312-2, and 312-M are reset to initial values. In some embodiments, the initial values refer to 0 ns for each delay units 312-1, 312-2, and 312-M. In some embodiments, the initial values refer to a predetermined non-zero delay for each delay units 312-1, 312-2, and 312-M.

In operation 620, delay control unit 310 controls driver circuit 120 according to the delays set by control logic and indication signal VIND from comparator 110. When the delays of delay units 312-1, 312-2, and 312-M are non-zero, delay control unit 310 turns on driving units 122 of driver 120 one at a time or turns off driving units 122 of driver 120 one at a time responsive to a signal level of indication signal VIND. In some embodiments, in operation 620, delay control unit 310 generates a plurality of control signals CTRL<0:M−1> according to the one or more delays of delay units 312-1, 312-2, and 312-M and indication signal VIND as illustrated in conjunction with FIG. 3. Each of the plurality of driving units 122 is controlled to turn on a corresponding current path between power supply node 170 and output node 190 or to turn off the corresponding current path between power supply node 170 and output node 190 responsive to a corresponding one of the plurality of control signals CTRL<0:M−1>. In some embodiments, delay units 312-1, 312-2, and 312-M generates control signals CTRL<0:M−1> by imposing corresponding delays to the indication signal VIND.

In operation 630, a digital value carried by one or more signals VDET indicative of the ripple voltage level Vripple (FIG. 5A) of feedback voltage VFB is generated by ripple detector 320. In some embodiments, the digital value is determined based on a voltage level of feedback voltage VFB. Ripple detector 320 provides one or more signals VDET to control logic 330.

In operation 640, control logic 330 set one or more delays of delay units 312-1, 312-2, and 312-M according to the detected ripple voltage level Vripple as represented by the generated digital value. In some embodiments, in operation 640, control logic 330 increases the one or more delays when the voltage level of the feedback voltage VFB is determined to be greater than that of a detection reference voltage VRH. In some embodiments, control logic 330 increases the one or more delays when the voltage level of the feedback voltage VFB is determined to be less than that of a detection reference voltage VRL. In some embodiments, control logic 330 decreases the one or more delays when the voltage level of the feedback voltage VFB is determined to be less than that of detection reference voltage VRH and greater than that of the detection reference voltage VRL. In some embodiments, the one or more delays is equal to or less than 50 ns.

In operation 650, control logic 330 determines if a reset instruction is received. When a reset instruction is received by control logic 330, the process proceeds to operation 610, where control logic 330 sets the one or more delays of delay units 312-1, 312-2, and 312-M back to the corresponding initial settings. When there is no reset instruction received by control logic 330, the process proceeds to operation 620, where driver 120 is controlled according to the current delays of delay units 312-1, 312-2, and 312-M and the voltage level of indication signal VIND.

Figure 7:
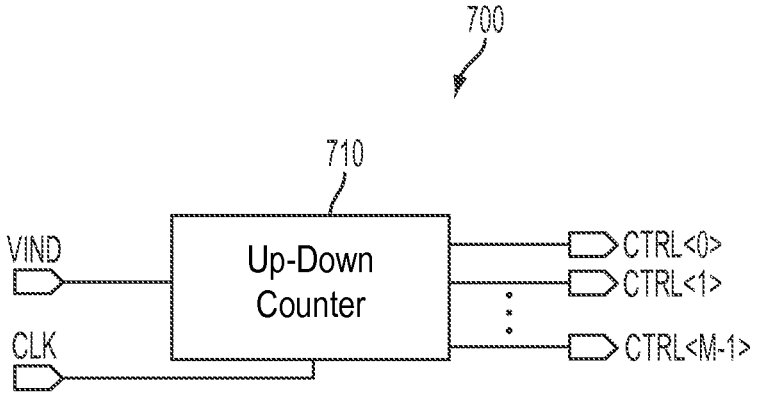
FIG. 7 is a diagram of another control unit in accordance with one or more embodiments.

FIG. 7 is a diagram of another control unit 700 in accordance with one or more embodiments. Control unit 700 is also usable as control unit 120 in FIG. 1. Control unit 700 includes an up-down counter 710.

Un-down counter 710 receives indication signal VIND and a clock signal CLK and generates a counter value according to an up/down counting direction (i.e., increasing or decreasing the counter value) and clock cycles of clock signal CLK. In some embodiments, up-down counter 710 outputs the counter value in a unary coding format as the plurality of control signals CTRL<0:M−1>. Because up-down counter 710 updates the counter value by a predetermined increment every time the clock signal CLK triggers the counting operation, a number of control signals CTRL<0:M−1> that are at high logic level is increased or decreased by a predetermined incremental value every cycle of clock signal CLK. As a result, a number of driving units 122 that are activated or deactivated is changed every clock cycle by the predetermined incremental value. In some embodiments, clock signal CLK has a period ranges from 5 ns to 50 ns.

Figure 8:
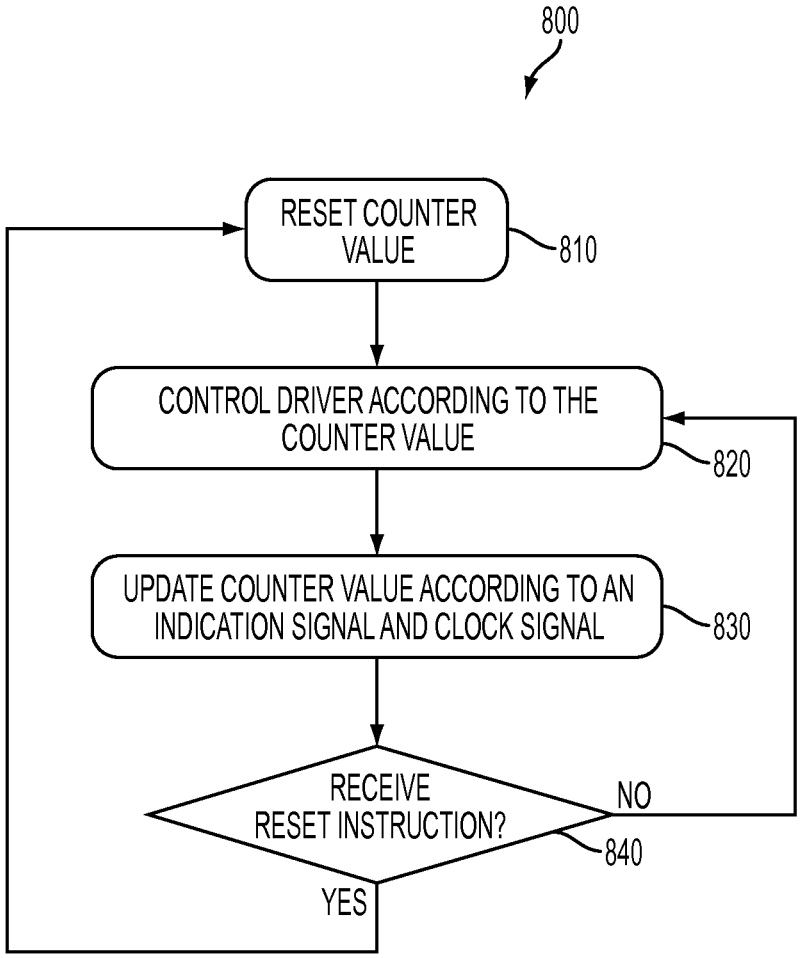
FIG. 8 is a flowchart of a method of operating a power converter including the control unit depicted in FIG. 7 in accordance with one or more embodiments.

FIG. 8 is a flowchart of a method 800 of operating a power converter 100 including the control unit 700 depicted in FIG. 7 in accordance with one or more embodiments. It is understood that additional operations may be performed before, during, and/or after the method 800 depicted in FIG. 8, and that some other processes may only be briefly described herein.

In operation 810, when power converter 100 is powered up, counter value stored in or accessible to up-down counter 710 is set to a predetermined initial value. In some embodiments, the initial value is 0. In some embodiments, the initial value is a predetermined non-zero value.

In operation 820, up-down counter 710 outputs the counter value in a unary coding format as the plurality of control signals CTRL<0:M−1>. Driving units 122 are controlled according to the plurality of control signals CTRL<0:M−1>.

In operation 830, up-down counter 710 updates the counter value as triggered by the clock signal CLK and an up-down counting direction indicated by the indication signal VIND. In some embodiments, when indication signal VCOM is set at a high logic level, up-down counter 710 increases the counter value by one each time the counting operation is triggered by clock signal CLK. In some embodiments, when indication signal VCOM is set at a low logic level, up-down counter 710 decreases the counter value by one each time the counting operation is triggered by clock signal CLK.

In operation 840, up-down counter 710 determines if a reset instruction is received. When a reset instruction is received by up-down counter 710, the process proceeds to operation 810, where up-down counter 710 resets the counter value to the predetermined initial value. When there is no reset instruction received by up-down counter 710, the process proceeds to operation 820, where driver 120 is controlled according to the current counter value of up-down counter 710.

In accordance with one embodiment, a power converter includes a power supply node, an output node, a plurality of driving units, a feedback unit, a comparator, and a control unit. Two or more of the plurality of driving units is configured to be activated to turn on a current path between the power supply node and the output node or to be deactivated to turn off the current path between the power supply node and the output node responsive to a plurality of control signals. The feedback unit is configured to provide a feedback voltage based on an output voltage at the output node. The comparator includes a first input terminal configured to receive the feedback voltage, a second input terminal configured to receive a reference voltage, and an output terminal configured to provide an indication signal generated based on a signal at the first input terminal of the comparator and a signal at the second input terminal of the comparator. The control unit is configured to generate the plurality of control signals based on the indication signal. The control unit is configured to, through the plurality of control signals, increase or decrease a number of activated driving units of the plurality of driving units by one or more predetermined increments at a time. The one or more predetermined increments are less than a total number of the plurality of driving units.

In accordance with another embodiment, a method of controlling a plurality of driving units in a power converter includes generating a digital value indicative of a voltage level of a feedback voltage. The feedback voltage is generated by a feedback unit based on an output voltage at an output node of the power converter. One or more delays are set according to the digital value. A plurality of control signals is generated according to the one or more delays and an indication signal. Two or more of the plurality of driving units are controlled to turn on corresponding current paths between a power supply node and the output node or turn off the corresponding current paths between the power supply node and the output node responsive to the plurality of control signals.

In accordance with another embodiment, a method of controlling a plurality of driving units in a power converter includes generating a counter value of an up/down counter based on an indication signal and a clock signal. The counter value is output in a unary coding format as a plurality of control signals. Two or more of the plurality of driving units are controlled to turn on corresponding current paths between a power supply node and the output node or turn off the corresponding current paths between the power supply node and the output node responsive to the plurality of control signals.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A power converter, comprising:

a power supply node;

an output node;

a plurality of driving units, two or more of the plurality of driving units being configured to be activated to turn on a current path between the power supply node and the output node or to be deactivated to turn off the current path between the power supply node and the output node responsive to a plurality of control signals;

a feedback unit configured to provide a feedback voltage based on an output voltage at the output node;

a comparator, comprising:

a first input terminal configured to receive the feedback voltage;

a second input terminal configured to receive a reference voltage; and an output terminal configured to provide an indication signal generated based on the signal at the first input terminal of the comparator and the signal at the second input terminal of the comparator; and a control unit comprising:

a ripple detector configured to generate a digital value based on the feedback voltage and at least one detection reference voltage, and a control logic configured to generate delay control signals according to the digital value from the ripple detector, wherein the control unit is configured to generate the plurality of control signals based on the indication signal, the control unit being configured to, through the plurality of control signals, increase or decrease a number of activated driving units of the plurality of driving units by one or more predetermined increments at a time, the one or more predetermined increments being less than a total number of the plurality of driving units.

2. The power converter of claim 1, wherein a driving unit of the plurality of driving units comprises one or more transistors.

3. The power converter of claim 2, wherein each of the one or more transistors of one of the plurality of driving units comprises a source terminal coupled to the power supply node, a drain terminal coupled to the output node, and a gate terminal coupled to a corresponding one of the plurality of control signals.

4. The power converter of claim 2, wherein the one or more transistors of one of the plurality of driving units are P-type transistors or the one or more transistors of one of the plurality of driving units are N-type transistors.

5. The power converter of claim 1, wherein each of the plurality of driving units comprises a plurality of sub units, and the power converter further comprises a decoder configured to enable a subset of the plurality of sub units of a corresponding one of the plurality of driving units responsive to one or more adjustment signals.

6. The power converter of claim 5, wherein the plurality of sub units of the plurality of driving units are arranged in columns and rows, and each row of sub units corresponds to one of the plurality of driving units.

7. The power converter of claim 1, wherein the control unit comprises a delay control unit configured to generate the plurality of control signals by imposing corresponding delays to the indication signal.

8. The power converter of claim 7, wherein the delay control unit comprises a plurality of buffers, each of the plurality of buffers has an output configured to generate a corresponding one of the plurality of control signals.

9. The power converter of claim 1, wherein the ripple detector comprises:

a first comparator configured to compare the feedback voltage with a first detection reference voltage; and a second comparator configured to compare the feedback voltage with a second detection reference voltage, the second detection reference voltage having a voltage level less than that of the first detection reference voltage.

10. The power converter of claim 7, wherein the control logic is configured to increase the corresponding delays when the first comparator of the ripple detector indicates that a voltage level of the feedback voltage is greater than that of the first detection reference voltage;

increase the corresponding delays when the second comparator of the ripple detector indicates that the voltage level of the feedback voltage is less than that of the second detection reference voltage; and decrease the corresponding delays when the first comparator of the ripple detector indicates that the voltage level of the feedback voltage is less than that of the first detection reference voltage and the second comparator of the ripple detector indicates that the voltage level of the feedback voltage is greater than that of the second detection reference voltage.

11. The power converter of claim 1, wherein the control unit comprises an up-down counter configured to generate a counter value according to the indication signal; and output the counter value in a unary coding format as the plurality of control signals.

12. The power converter of claim 11, wherein the up-down counter is operated according to a clock signal.

13. A method of controlling a plurality of driving units coupled between a power supply node and an output node in a power converter, the method comprising:

generating a digital value indicative of a voltage level of a feedback voltage, the feedback voltage being generated by a feedback unit based on an output voltage at the output node of the power converter;

setting one or more delays according to the digital value;

increasing the one or more delays based on a first detection reference voltage and a second detection reference voltage;

generating a plurality of control signals according to the one or more delays and an indication signal; and controlling two or more of the plurality of driving units to turn on corresponding current paths between the power supply node and the output node or turn off the corresponding current paths between the power supply node and the output node responsive to the plurality of control signals, wherein a first driving unit of the plurality of driving units receives a first control signal of the plurality of control signals, and a second driving unit of the plurality of driving units receives a second control signal of the plurality of control signals, wherein the second control signal is generated by delaying the first control signal.

14. The method of claim 13, wherein the generating the plurality of control signals comprises imposing corresponding delays of the one or more delays to the indication signal.

15. The method of claim 13, wherein the setting the one or more delays comprises:

increasing the one or more delays when the voltage level of the feedback voltage is determined to be greater than a voltage level of the first detection reference voltage; and increasing the one or more delays when the voltage level of the feedback voltage is determined to be less than a voltage level of the second detection reference voltage.

16. The method of claim 15, wherein the setting the one or more delays further comprises:

decreasing the one or more delays when the voltage level of the feedback voltage is determined to be less than the voltage level of the first detection reference voltage and greater than the voltage level of the second detection reference voltage.

17. The method of claim 13, further comprising resetting the one or more delays responsive to a reset instruction.

18. The method of claim 13, wherein the one or more delays are equal to or less than 50 nanoseconds (ns).

19. A method of controlling a plurality of driving units coupled between a power supply node and an output node in a power converter, the method comprising:

generating a counter value of an up/down counter based on an indication signal and a clock signal;

outputting the counter value in a unary coding format as a plurality of control signals;

controlling two or more of the plurality of driving units to turn on corresponding current paths between the power supply node and the output node or turn off the corresponding current paths between the power supply node and the output node responsive to the plurality of control signals; and through the plurality of control signals, increasing or decreasing a number of activated driving units of the plurality of driving units by one or more predetermined increments at a time, the one or more predetermined increments being less than a total number of the plurality of driving units.

20. The method of claim 19, further comprising resetting the counter value responsive to a reset instruction.

21. The method of claim 19, wherein the clock signal has a period ranges from 5 nanoseconds (ns) to 50 ns.

* * * * *